US006684602B2

(12) United States Patent
Reinecke

(10) Patent No.: US 6,684,602 B2
(45) Date of Patent: Feb. 3, 2004

(54) COMPACT BOTTLING MACHINE

(75) Inventor: Günter Reinecke, Solingen (DE)

(73) Assignee: Sig Hamba Filltech GmbH & Co. KG, Neunkirchen/Saar (DE)

( * ) Notice: Subject to any disclaimer, the term of this patent is extended or adjusted under 35 U.S.C. 154(b) by 78 days.

(21) Appl. No.: 09/793,726

(22) Filed: Feb. 26, 2001

(65) Prior Publication Data

US 2001/0030168 A1 Oct. 18, 2001

(30) Foreign Application Priority Data

Feb. 25, 2000 (DE) ..... 100 08 874

(51) Int. Cl.[7] ..... B65B 65/08
(52) U.S. Cl. ..... 53/167; 53/48.1; 53/48.5
(58) Field of Search ..... 53/167, 48.1, 48.5, 53/48.7

(56) References Cited

U.S. PATENT DOCUMENTS 3,285,410 A * 11/1966 Brunsing
3,395,509 A * 8/1968 Erickson
5,724,785 A * 3/1998 Malanowski ..... 53/48.1

FOREIGN PATENT DOCUMENTS

DE 24 60 175 7/1976
DE 196 42 987 4/1998

* cited by examiner

*Primary Examiner*—Eugene Kim
*Assistant Examiner*—Sameh Tawfik
(74) *Attorney, Agent, or Firm*—Herbert Dubno

(57) ABSTRACT

A bottling apparatus has a frame having a horizontally extending upper portion and a horizontally extending lower portion separated from the upper portion by an open space and an endless conveyor element on the frame having a horizontal lower stretch in the frame lower portion, an upper stretch above the space in the frame upper portion, and upstream and downstream upright stretches extending between and interconnecting upstream and downstream ends of the upper and lower stretches. A drive advances the element continuously in a horizontal transport direction in the lower stretch. A plurality of holders secured to the element each form a transverse row of seats adapted to fit snugly around necks of respective bottles which are loaded into the holders at the upstream end of the lower stretch with mouths of the bottles open upward into the space and the bottles hanging by their necks from the lower stretch. Machines or subassemblies carried on the frame lower portion in the space below the frame upper portion clean, fill, and cap bottles in the seats moving in the transport direction. The frame forms below the lower portion a space accommodating bodies of the bottles hanging from the holders in the lower stretch.

5 Claims, 6 Drawing Sheets

COMPACT BOTTLING MACHINE

FIELD OF THE INVENTION

The present invention relates to an apparatus for filling and handling bottles.

BACKGROUND OF THE INVENTION

A standard bottling machine as described in German patent document 196 42 987 filed Oct. 18, 1996 by P. Gustafsson et al has a conveyor running along an annular path with straight lower and upper stretches. The conveyor is provided with a succession of holders each having eight basket-like seats capable of gripping eight bottles around their necks, with the bottles only and upright (i.e. with their necks up) in the upper stretch. The lower stretch is the return stretch where the seats return to the upstream end of the upper stretch upside-down and empty. Means is provided above the upper stretch for sterilizing, filling, and capping the bottles.

Such a machine is quite bulky. Space must be provided between the stretches of the conveyor and below its lower stretch to accommodate the bottles or their holders. More space is taken up above the upper stretch for the sterilizing, filling, and capping units. Thus if the machine is designed for use with tall bottles, it must have a height equal at least to twice the bottle height plus the height of the sterilizing, filling, and capping units.

OBJECTS OF THE INVENTION

It is therefore an object of the present invention to provide an improved bottling machine.

Another object is the provision of such an improved bottling machine which overcomes the above-given disadvantages, that is which is very compact, even if used to process tall bottles.

SUMMARY OF THE INVENTION

A bottling apparatus has according to the invention a frame having a horizontally extending upper portion and a horizontally extending lower portion separated from the upper portion by an open space and an endless conveyor element on the frame having a horizontal lower stretch in the frame lower portion, an upper stretch above the space in the frame upper portion, and upstream and downstream upright stretches extending between and interconnecting upstream and downstream ends of the upper and lower stretches. A drive advances the element continuously in a horizontal transport direction in the lower stretch. A plurality of holders secured to the element each form a transverse row of seats adapted to fit snugly around necks of respective bottles which are loaded into the holders at the upstream end of the lower stretch with mouths of the bottles open upward into the space and the bottles hanging by their necks from the lower stretch. Machines or subassemblies carried on the frame lower portion in the space below the frame upper portion clean, fill, and cap bottles in the seats moving in the transport direction.

Thus with this system the bottle size need merely be accommodated underneath the lower conveyor stretch. Thus if enough clearance is provided there to accommodate the largest possible bottle, the same machine can be used for large and small bottles with no significant refitting. In addition since the bottle height does not have to be accommodated between the upper and lower conveyor stretches because the bottles are not moved in this area and they are held by their necks so no tall holders are used, the overall height of the machine can be reduced.

The frame forms below the lower portion a space accommodating bodies of the bottles hanging from the holders in the lower stretch. In addition the frame has upright end portions joining upstream and downstream ends of the frame upper and lower portions.

The bottling apparatus in accordance with the invention further has a center support extending through the space between the frame end portions and centrally supporting the frame upper portion on the frame lower portion. This center support is a portal extend transversely over the lower stretch.

The frame is hollow to accommodate steam and other feed lines, for instance for the sterilizing unit.

Upstream and downstream ends of the frame upper and lower portions are provided with wheels over which the conveyor is spanned. The drive is directly connected to only one of the wheels and the other wheels idle. The one drive wheel is at an end of the frame upper portion and the drive is a variable-speed electric servomotor.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
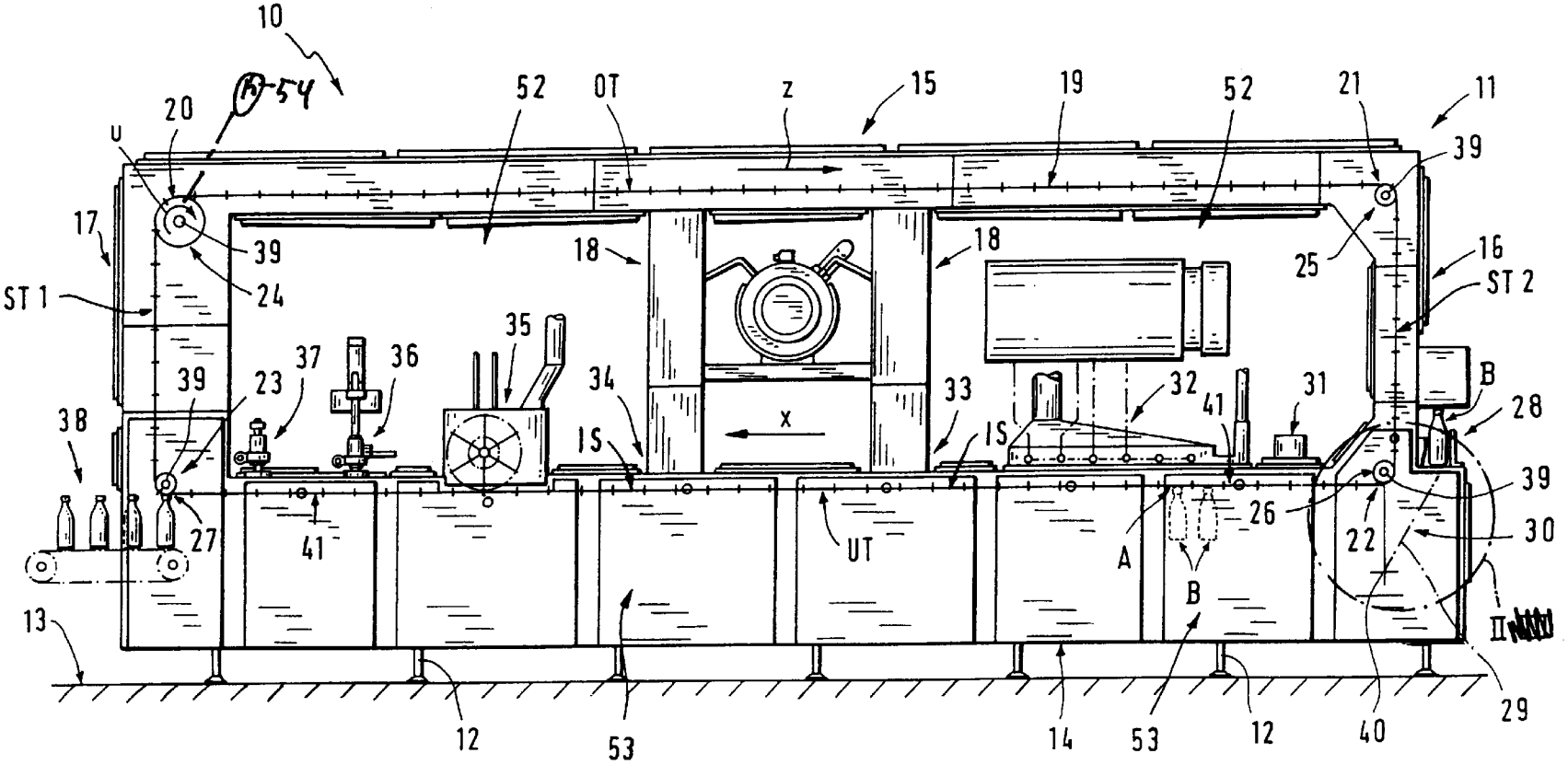
FIG. 1 is a small-scale side view of the bottling system according to the invention.

As seen in FIG. 1 a bottling system 10 in accordance with the invention has an open frame 11 supported via feet 12 on the floor or ground 13 and having a horizontally extending lower portion 14, a parallel upper portion 15, and upstream and down-stream end uprights 16 and 17 connecting the ends of the portions 14 and 15. Centrally two further uprights 18 support the center of the upper portion 15. The frame parts 15, 16, 17, and 17 are hollow so that feed lines and such as described in German patent document 2,460,175 filed Dec. 19, 1974 by F. Bocker can be accommodated in them.

An endless conveyor chain 19 passes at upper corners 20 and 21 and lower corners 22 and 23 around respective wheels or rollers 24, 25, 26, and 27 carried on respective axles 39 and driven by a variable-speed electric servomotor 54 to rotate in a direction u (see corner 20). Thus a straight and horizontal lower conveyor stretch UT moves in the lower frame portion 14 in a transport direction x, an upper straight and horizontal stretch OT moves oppositely in the upper portion 15 in a direction z, and downstream and upstream upright stretches ST1 and ST2 connect the downstream and upstream ends of the upper and lower stretches OT and UT. The chain 19 here is a double chain, but could be a single chain or belt.

An intake station 28 at the lower upstream corner 22 has a loader 29 having a pivotal bottle holder 30 that fits PET bottles B to the conveyor 19, whence they are moved in the transport direction x through a sensor station 31 which determines if any bottles are missing, a sterilizing station 32, a first filling station 33, a second filling station 34, a cap-cleaning and —feeding station 35, a cap fitting station 36, a cap crimping station 37, and an unloading station 38 at the lower downstream corner 23. The filling stations 33 and 34 load respective basically liquid materials, e.g. crushed fruit and yoghurt, into the bottles B and may correspond to the system shown in U.S. Pat. No. 4,862,933. The sterilizing system may correspond to that of German patent document 196 42 987 filed Oct. 18, 1996 by P. Gustafsson et al. The unloading station 38 is a simple conveyor on which the bottles B are set after being released from the conveyor 19 as described below.

Figure 2:
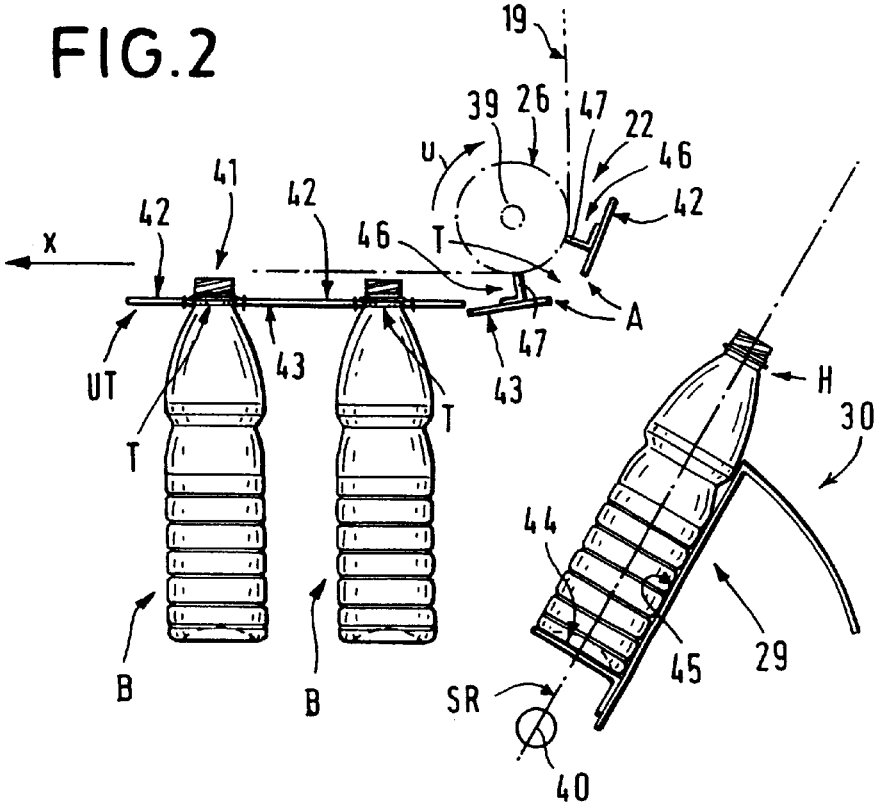
FIGS. 2 through 7 are larger-scale views of the loading subsystem in the area indicated at II in FIG. 1.
Figure 8:
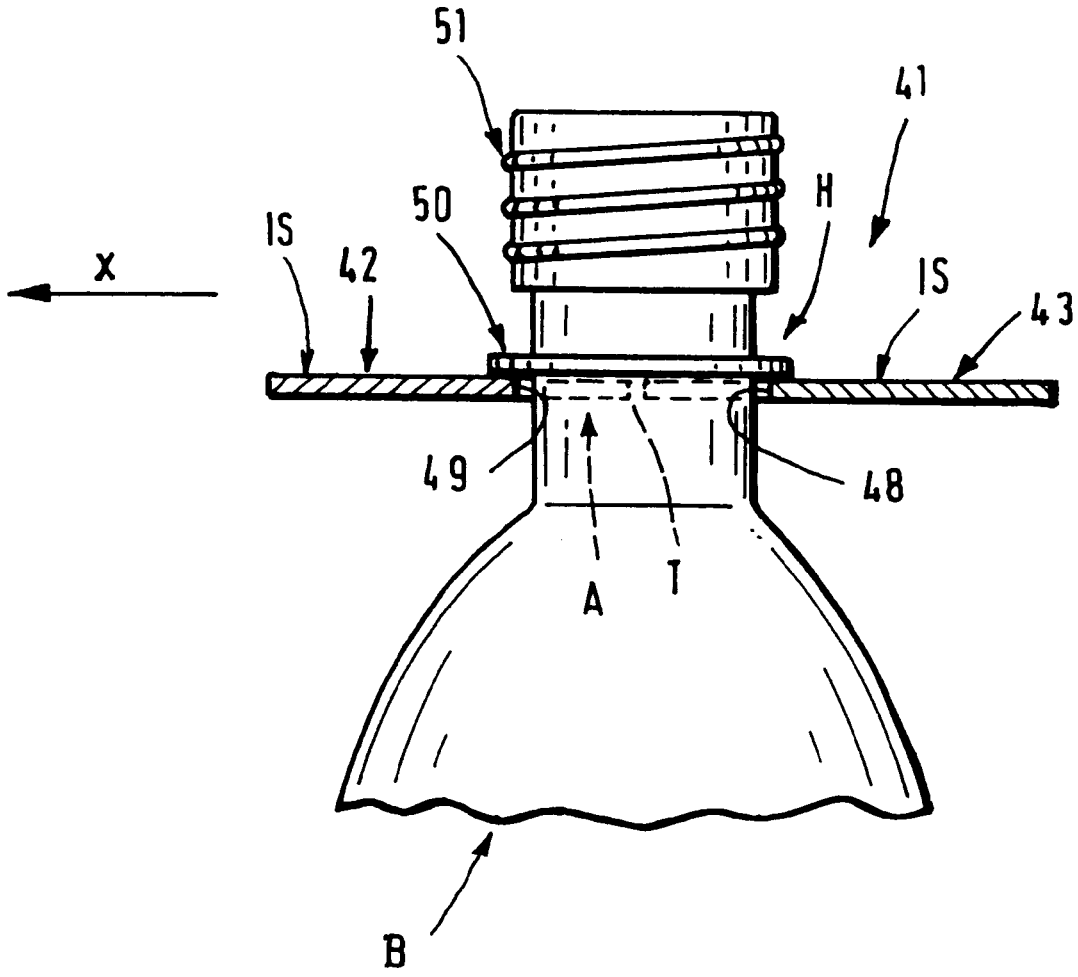
FIG. 8 is a larger-scale view of a bottle top.
Figure 9:
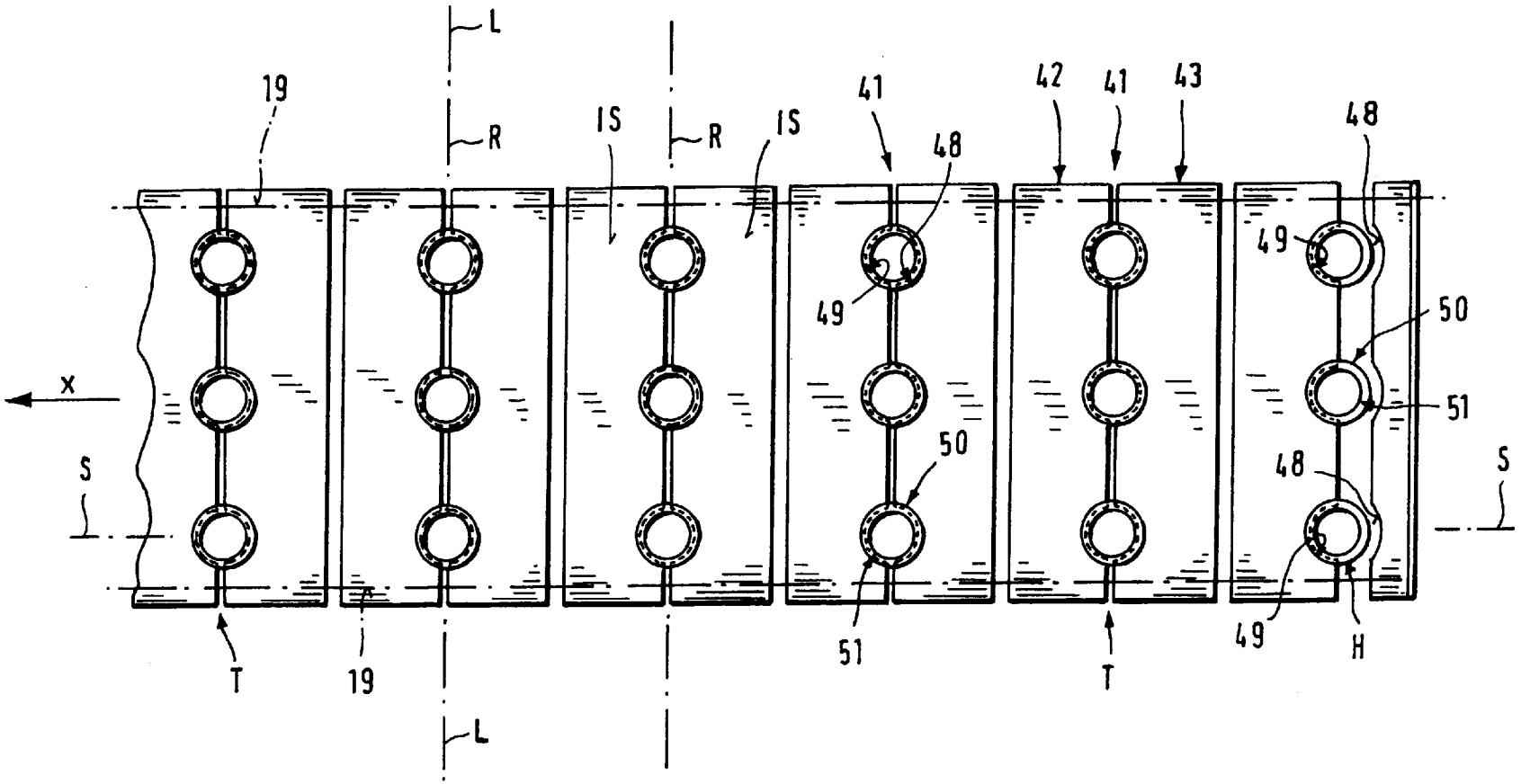
FIG. 9 is a top view of the conveyor of the bottling system.

The conveyor chain 19 carries a series of holders 41 each formed as best shown in FIG. 9 of a pair of plates 42 and 43 that have confronting edges at a joint T where they are each formed with three semicircular cutouts 48 and 49 forming seats A (FIG. 2) aligned in columns S parallel to the direction x and rows R perpendicular thereto and centered on transverse lines L. The bottles B each have as shown in FIG. 8 a neck H formed with a radially outwardly projecting rim 50 adapted to sit on the top faces of the plates 42 and 43, with a threaded portion 51 of each neck H extending upward from the conveyor 19. The plates 42 and 43 are separated by spacers 46 constituted as L-brackets 47 from the conveyor chain 19. Thus as the conveyor chain 19 goes around the corners 22 and 23, each downstream plate 42 will separate from the respective upstream plate 43 to open up the seats A and allow bottles B to be loaded in and taken out. Similarly at the downstream corner 23 the plates 42 and 43 separate so the bottles B are set down on the unloading conveyor 38.

Figure 3:
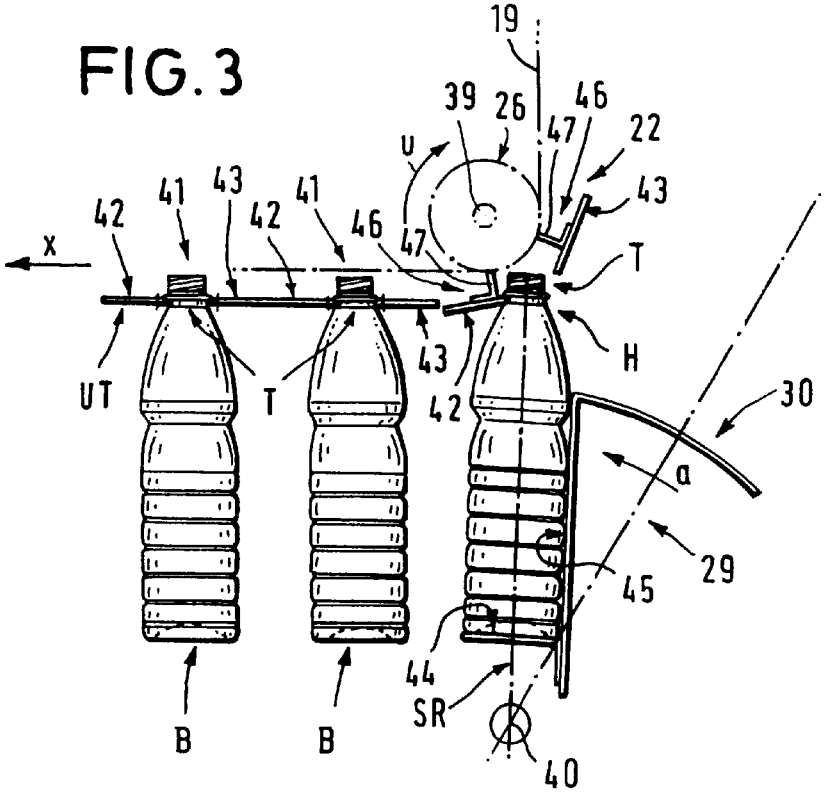
Figure 4:
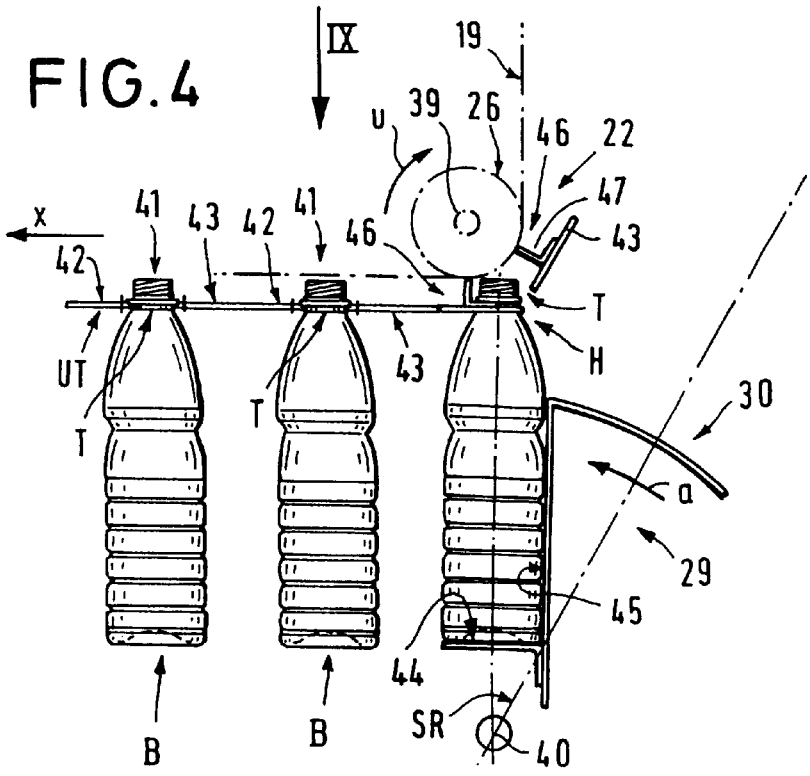
Figure 5:
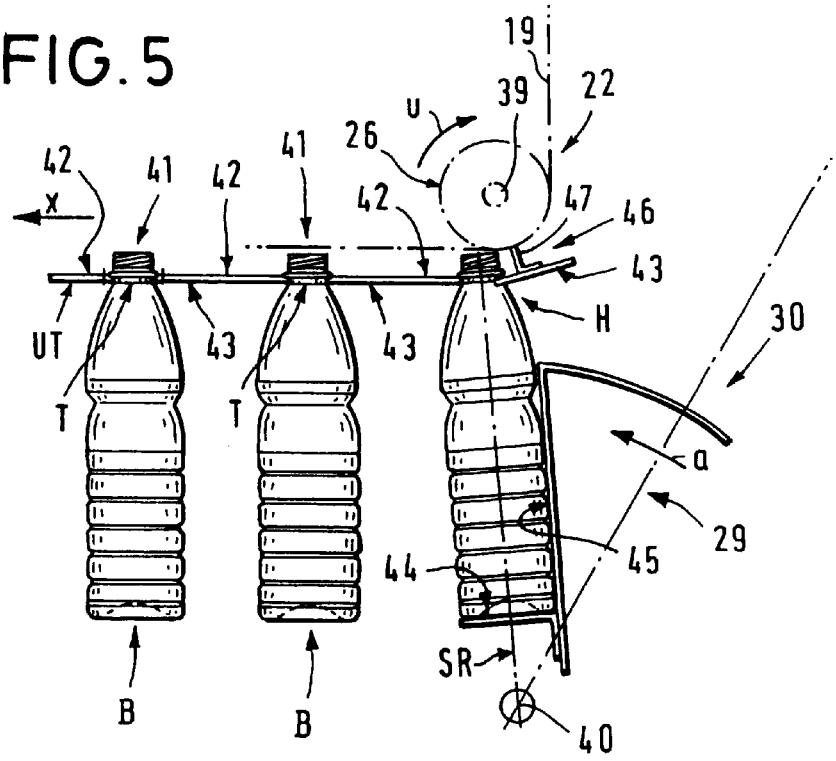
Figure 6:
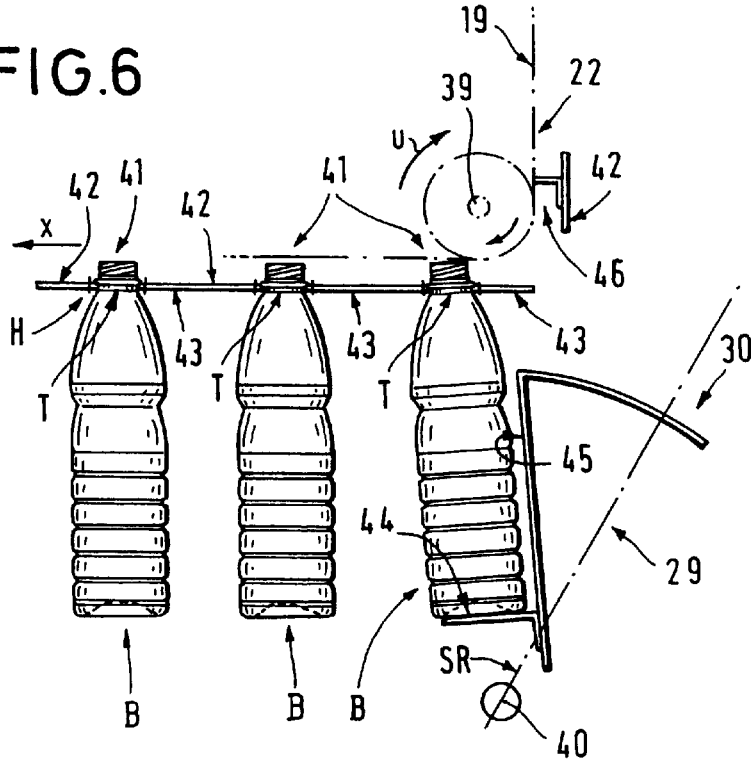
Figure 7:
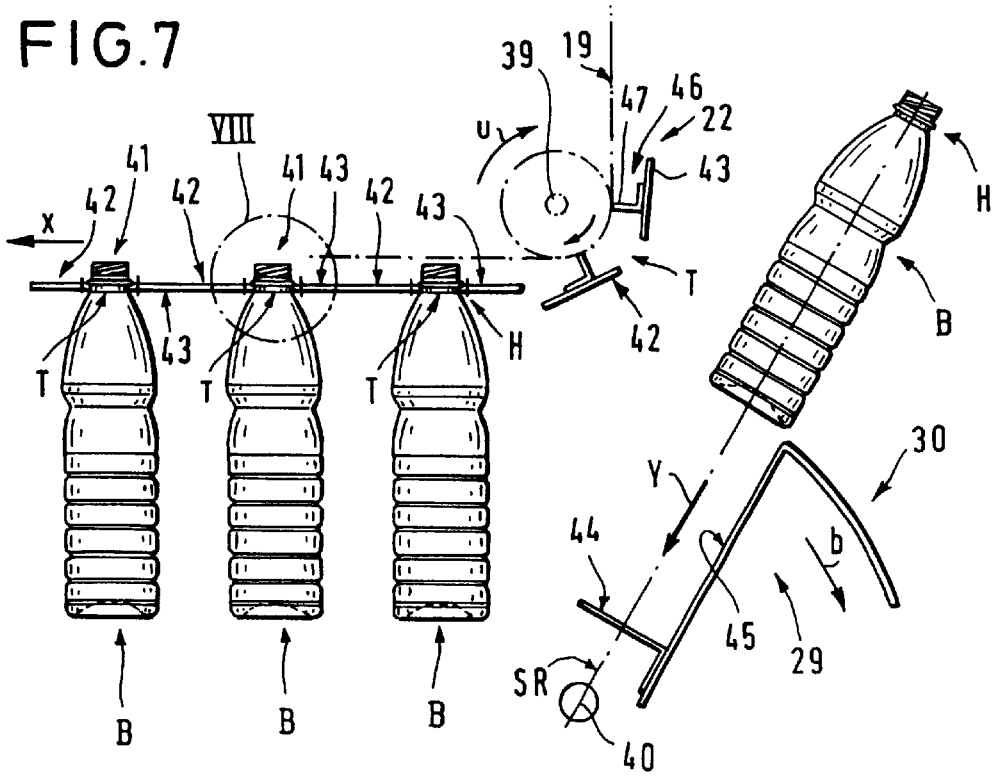

The loading device 29 is pivotal in directions a and b about an axis 40 parallel to the axle 39 of the corner roller 26 and comprises a base plate 44 on which the bottoms of the bottles B are set and a side plate 45 against which the sides of the bottles B rest. This loader 29 is pivoted up in the direction a from the position of FIG. 2 to that of FIG. 3 to fit the necks H of the bottles B it carries to the cutouts 49 of the leading or downstream plate 42 coming around the corner 22 and then as shown in FIGS. 4 and 5 the following or upstream plate 43 pivots into place to capture the necks H in the seats A. Then as shown in FIG. 6 the continuously advancing conveyor 19 picks the bottles B off the loader 29 so that, after the loader 29 has been pivoted back in the direction b as shown in FIG. 7, more bottles B can be slid down in direction Y into the loader 29.

The open frame parts 14, 15, 16, and 17 define a central open space 52 that accommodates the machines or units 31 through 37. Thus these subassemblies face inner faces IS of the holders 41. Underneath the lower stretch UT is a space 53 in which the bottles B hang as they are cleaned, filled, and capped. Since the bottles B are hung by their necks, there is no need to provide headroom for holders above the units 31 through 37, so that overall height of the machine 10 can be fairly small. All that is necessary is that there be sufficient clearance in the lower space 53 to accommodate the largest possible bottle B to be filled by the machine 10.

I claim:

1. A bottling apparatus comprising:

a frame having a horizontally extending and straight upper portion, a horizontally extending and straight lower portion separated from the upper portion by a laterally open space, and mutually parallel upright and straight end portions joining upstream and downstream ends of the frame upper and lower portions to form a rectangle therewith;

an endless conveyor element on the frame and having a straight horizontal lower stretch in the frame lower portion, a straight upper stretch above the space in the frame upper portion, and mutually parallel straight upstream and downstream upright stretches extending in the upright end portions between and interconnecting upstream and downstream ends of the upper and lower stretches;

wheels at upstream and downstream ends of the frame upper and lower portions and at junctions of the end portions therewith over which the conveyor is spanned;

drive means for advancing the element in a horizontal transport direction in the lower stretch and consisting of a drive connected to only one of said wheels at an end of said upper portion, the remaining wheels idling;

a plurality of holders secured to the element and each forming a transverse row of seats adapted to fit snugly around necks of respective bottles;

the frame forming below the lower portion a space accommodating bodies of the bottles hanging from the holders in the lower stretch all along the length thereof;

means for loading bottles into the holders at the upstream end of the lower stretch with mouths of the bottles open upward into the space and the bottles hanging by their necks from the lower stretch whereby said space is free from the bodies of the bottles; and means including machines carried on the frame lower portion in the space below the frame upper portion for cleaning, filling, and capping bottles in the seats moving in the transport direction.

2. The bottling apparatus defined in claim 1, further comprising a center support extending through the space between the frame end portions and centrally supporting the frame upper portion on the frame lower portion.

3. The bottling apparatus defined in claim 2 wherein the center support is a portal extending transversely over the lower stretch.

4. The bottling apparatus defined in claim 1 wherein the frame is hollow.

5. The bottling apparatus defined in claim 1 wherein the drive means is a variable-speed electric servomotor.

* * * * *